United States Patent [19]

Johnson et al.

[11] Patent Number: 4,540,472

[45] Date of Patent: Sep. 10, 1985

[54] METHOD FOR THE ELECTRODEPOSITION OF AN IRON-ZINC ALLOY COATING AND BATH THEREFOR

[75] Inventors: William R. Johnson, Trafford; Larry E. Pfister, Pittsburgh, both of Pa.

[73] Assignee: United States Steel Corporation, Pittsburgh, Pa.

[21] Appl. No.: 677,423

[22] Filed: Dec. 3, 1984

[51] Int. Cl.[3] ..... C25D 3/56; C25D 5/04

[52] U.S. Cl. ..... 204/28; 204/44.2

[58] Field of Search ..... 204/44.2, 28, 44.5, 204/123

[56] References Cited

U.S. PATENT DOCUMENTS

| | | | |
|---|---|---|---|
| 2,778,787 | 1/1957 | Salt | 204/44.5 |
| 4,290,860 | 9/1981 | Matsudo et al. | 204/27 |
| 4,488,942 | 12/1984 | Martin et al. | 204/44.2 |

*Primary Examiner*—G. L. Kaplan

*Attorney, Agent, or Firm*—Arthur J. Grief

[57] ABSTRACT

In the electrodeposition of iron-zinc alloy coatings, a lustrous, adherent iron-zinc coating containing 10–20% iron is achieved over a current density range of 400–1600 amps/ft$^2$ and line speeds of 100–500 ft/min. by employing an electrolyte maintained at a temperature of 130° to 160° F. which contains $FeCl_2$, $ZnCl_2$, KCl, $K_2SO_4$, a chelating agent such as citric acid, and a minor amount of an adduct composed primarily of polyalkylene glycols.

8 Claims, 2 Drawing Figures

METHOD FOR THE ELECTRODEPOSITION OF AN IRON-ZINC ALLOY COATING AND BATH THEREFOR

Figure 1:
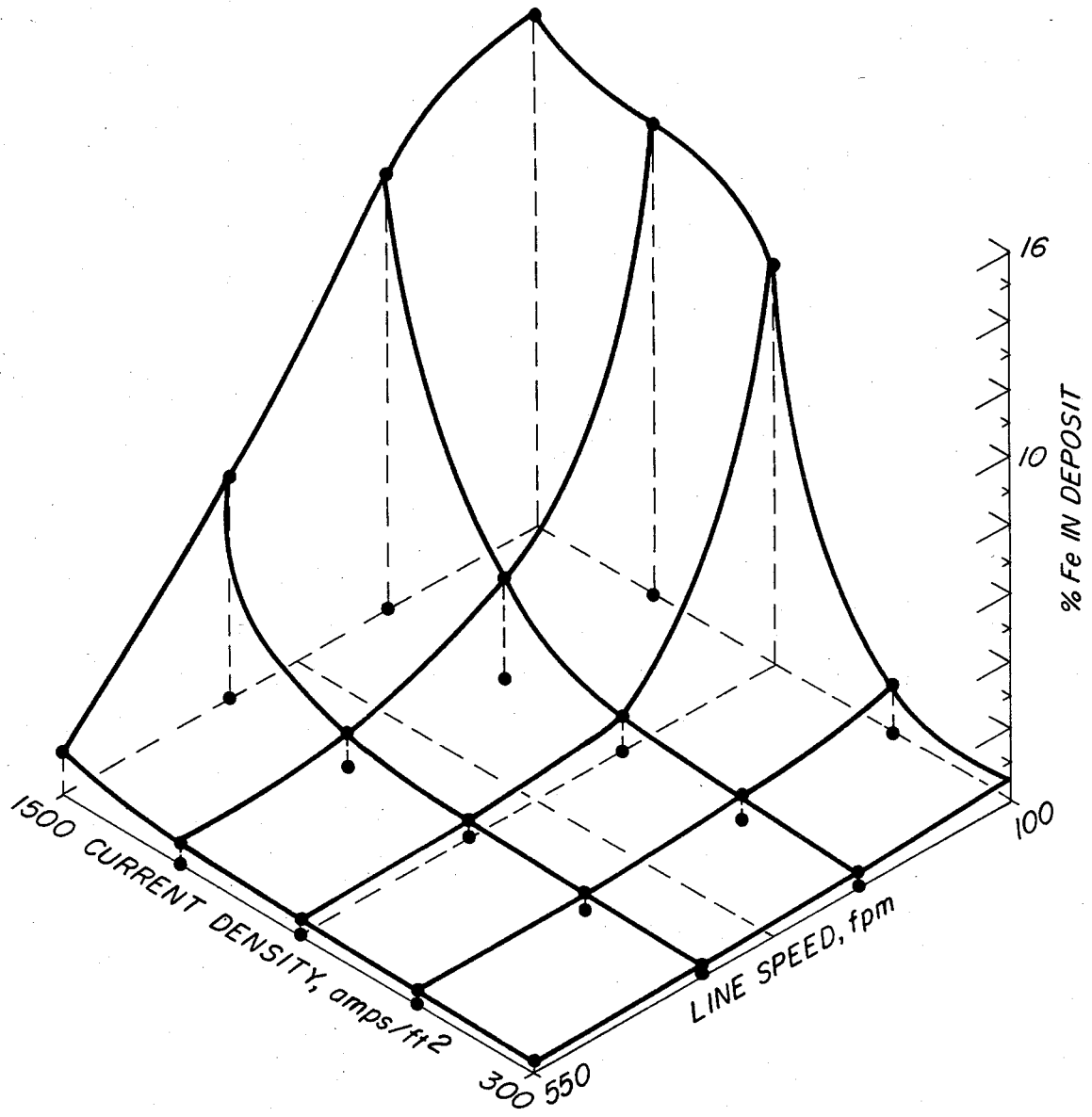

This invention relates to the electroplating of iron-zinc alloy coatings and is more particularly related to the use of a chloride-base electrolyte for effecting such coatings.

The increased interest in corrosion protection for automobiles in the past few years has spawned increased activity in the development of coatings that will provide desired protection for the steel substrate. Hot-dip galvanized products have been successfully employed for various unexposed parts. In areas where a good surface is required, one side electrogalvanized coatings and zinc enriched paints have been employed. The desire for even greater rust protection, particularly for cosmetic reasons, has lead to the growing use of two-side, differentially coated hot-dip and electrogalvanized products. To reduce zinc coating weight requirements, a number of electroplated zinc alloy coatings have been proposed. The codeposition of zinc with more noble metals such as nickel, iron, cobalt, chromium, tin and tungsten have been found to provide, in comparatively thinner coating layers, corrosion protection which outperforms thicker zinc coatings in various accelerated corrosion tests. In some instances, the paintability of such zinc alloy coatings has also been found to be superior to that of a pure zinc surface.

Studies performed by a number of researchers, have shown that a coating composed of an iron-zinc alloy containing 10–20% iron and 5–10 microns in thickness, provides optimum results for corrosion performance, paintability and formability. A variety of cell arrangements and electrolytes are available for the plating of such iron-zinc alloy coatings. T. Irie et al, Proceedings of the Fourth AES Continuous Strip Plating Symposium, 1984, have shown that the cathodic efficiency and electric conductivity of chloride-base baths are substantially superior to sulfate-base baths, such that the former baths can provide higher productivity in combination with lower electrical power costs. As shown by Irie et al, however, the iron content in the deposition coating is a function of both the current density applied, and the strip line speed, such that the iron content increases rapidly with increases in current density or decreases in line speed. It was found, however, that such anomalous codeposition could be avoided by materially increasing the concentration of chloride ion. While the problem of anomalous codeposition can substantially be overcome by increasing the concentration of chloride ion, the appearance and the adherence of the deposit are nevertheless dependent on current density—such that current densities greater than 100 amps/dm$^2$ (929 amps/ft$^2$) must be employed to achieve coatings with desired appearance. Although producers normally prefer to utilize current densities of about 1000 amps/ft$^2$ or greater, to maximize productivity, it is frequently the case, due for example to mechanical problems and coil transfers, that the plating line must be slowed down and the plating current density correspondingly decreased to achieve the desired coating weight. It is therefore desirable that an electrolyte be capable of providing a combined plating capability of (i) a consistent codeposition of iron and zinc over a wide range of line speeds and current densities with (ii) a coating with desirable appearance and adherence over that same wide range.

It has now been found that a chloride-base electrolyte can be modified to provide such a combined plating capability by the addition of a small amount of sulfate ions, and that such capability can further be enhanced by employing an adduct containing one or more polyalkylene glycols having a molecular weight within the range 600–1050.

Figure 2:
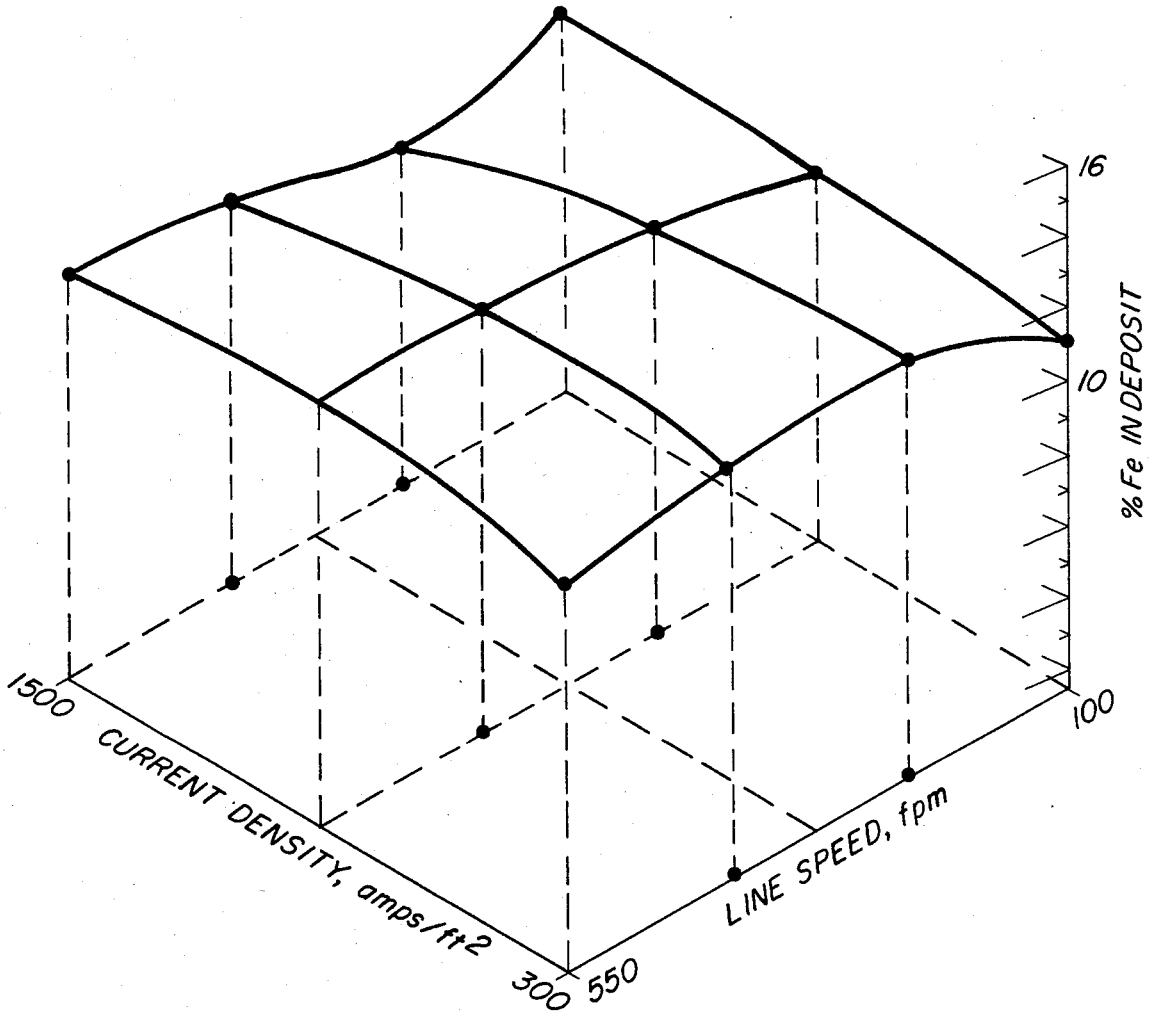

The advantages of this finding will be better understood from a reading of the following description when read in conjunction with the appended claims and the drawings, in which:

FIG. 1 is a three dimensional graph illustrating the effect of current density and line speed on coating composition from a conventional iron-zinc electrolyte and, FIG. 2 is a similar graph illustrating the widening of the uniform coating range achieved by utilizing the electrolyte of this invention.

Initially, laboratory tests were conducted in circulation cells, designed to simulate commercial-strip plating conditions, wherein electrolyte was flowed past a stationary cathode and anode at speeds equivalent to those of a commercial-strip plating line. Two different size circulation cells were employed, each capable of simulated line speeds of up to 600 feet/min. (183 m/min.) and current densities of up to 2500 amps/ft$^2$ (269 amps/dm$^2$). Steel samples 0.79 mm thick were electrolytically cleaned in an alkaline cleaning solution and pickled in an HCl solution prior to plating. Initial studies utilizing a conventional chloride-based electrolyte composed of $Fe^{2+}$ and $Zn^{2+}$ ions resulting from the dissolution of simple metal chloride salts at a concentration proportion comparable to the desired coating composition (not more than 240 g/l total $Cl^{31}$ concentration) indicated, that to avoid anomalous codeposition in such an electrolyte, plating must be limited to fairly low current densities, i.e., less than about 400 amps/ft$^2$. Results utilizing this electrolyte are shown in FIG. 1, where it is seen that the iron content in the coating decreased drastically with increased line speed and/or with increased current density. Such behavior would preclude strip-plating operations on any commercial facility where major line speed changes would be encountered.

It was thereafter determined that the conventional iron-zinc chloride electrolyte could be modified such that the coating composition is primarily a function of the iron and zinc ratios in the electrolyte and not a function of the line speed or current density. FIG. 2 shows the results obtained utilizing the modified electrolyte—in which the iron to zinc ratio of the coating is substantially constant over a broad range of current densities and line speeds. The coating obtained from this modified electrolyte is both adherent and exhibits a desireable apperance. It should be noted, however, that while the iron content of the coating is substantially a function of the percentage of iron to the total metal concentration of the electrolyte, that the ratio of iron in the coating is somewhat higher than the iron to total metal ratio in the electrolyte. For example, 10% iron in the solution total metal content produces about a 13% iron content in the coating.

The chloride-base electrolyte will contain the following ingredients:

(a) $Fe^{2+}$ in an amount of 4 to 10 g/l—preferably added as $FeCl_2$, (b) $Zn^{2+}$ in an amount of 50–80 g/l—preferably added as $ZnCl_2$. It was found that these ranges of $Fe^{2+}$ and $Zn^{2+}$ provide a sufficiently high metal ion concentration to enable plating at current densities of up to 1600 amps/ft.$^2$, (c) $Cl^-$ in an amount of 240–300 g/l—preferably added as KCl. In agreement with the findings of Irie et al, a minimum concentration of about 240 g/l is desirable to prevent anomalous codeposition. Increasing the concentration of $Cl^-$ also enhances bath conductivity, thereby decreasing power requirements, (d) $SO_4^{2-}$ in an amount of 6–12 g/l—preferably added is $K_2SO_4$. Sulfate ion in this range is desirable to, (1) provide increased bath stability over long periods of time and (2) widen the current density range (particularly at the low end of the range) at which a lustrous coating may be obtained, (e) A chelating agent in an amount sufficient to prevent precipitation of insoluble ferric ion. Various chelating agents such as citrates, acetates and succinates may be employed. In the instant electrolyte, citrate ion in an amount of 0.5–5 g/l has been found to be particularly desirable—preferably added as citric acid, and (f) From 0.5–2 ml/l of an adduct containing one or more polyalkylene glycols having a molecular weight of 600–1050. Adducts of this nature, at concentrations about an order of magnitude lower, have been used as grain refiners in the electrodeposition of pure zinc coatings. It has been found that these adducts, when employed in the higher concentrations set forth, broaden the current density and line speed range at which a fairly lustrous, adherent coating may be obtained and, in addition, broaden the plating range over which consistent codeposition may be achieved. Particularly preferred are the polyethylene glycols, employed individually or as a mixture in an amount of 0.7–1.2 ml/l.

The results of the laboratory tests were verified in two different electroplating systems—(i) a pilot line utilizing a conventional vertical-pass plating system, capable of providing up to 32,000 plating amperes and handling strip up to 10 inches wide at speeds of up to 500 feet/min. and (ii) a radial type plating system somewhat similar to that shown in U.S. Pat. No. 3,483,113. The latter system eliminates throwaround and edge build-up by passing a strip around a large diameter conductor roll, the conducting surface of which is only the center portion of the roll circumference—with the remainder of the roll surface being an elastomer. Because the steel strip passes tightly around the roll, the edges are sealed against the elastomeric portions of the roll—preventing electrodeposition on the surface in contact with the roll. Curved anodes are installed opposite the strip, and plating electrolyte is circulated between the anodes and the strip. Plating-power costs are minimized by utilizing an anode-to-strip gap of about 1 inch, soluble zinc-base anodes (e.g., pure Zn or Zn—Fe alloy) and a highly conductive chloride-base electrolyte. The latter system can be utilized to produce one-side coatings or two-side coatings, with each surface being coated at different times. This concept also permits one type of coating to be applied to a surface while a different coating is applied to the other surface. Similarly, differential coating thickness on each surface may easily be produced.

As noted above, the instant electrolyte may suitably be employed in any of the well known electrodeposition systems. The desired iron-zinc alloy coatings containing from 10–20% Fe, preferably 12–18% Fe, may be deposited onto a steel strip travelling at a line speed of from 100–500 feet/min, in which deposition is effected by supplying a current density of from 400–1600 amps/ft$^2$ to the strip. The electrolyte, preferably having a temperature of 130° to 160° F. and a pH of 2 to 3.5 is pumped or otherwise flowed across the surface of the strip at a flow-rate sufficiently high to permit the requisite current density to be applied.

We claim:

1. An electrolyte for the electrodeposition of an Fe-Zn alloy coating, consisting essentially of 4–10 g/l of $Fe^{2+}$, 50–80 g/l $Zn^{2+}$, 240–300 g/l $Cl^-$, 6–12 g/l $SO_4^{2-}$, 0.05–5 g/l of a chelating agent in an amount sufficient to prevent the formation of ferric ion precipitates, 0.5 to 2 ml/l of an adduct containing one or more polyalkylene glycols having a molecular weight of 600–1050, balance $H_2O$.

2. The electrolyte of claim 1, in which said chelating agent is the citrate ion and said polyalkylene glycols are polyethylene glycols.

3. The electrolyte of claim 2, in which said polyethylene glycols are employed within the range 0.7 to 1.2 ml/l.

4. The electrolyte of claim 1, in which said polyalkylene glycols are polyethylene glycol and are employed within the range 0.7 to 1.2 ml/l.

5. In the electrodeposition of Fe-Zn alloy coatings onto a steel strip travelling at a line speed of 100 to 500 ft/min., in which such deposition is effected by supplying a current density of 400 to 1600 amps/ft$^2$ to the strip through a soluble zinc-base anode and a chloride-base electrolyte which is circulated between the strip and the anode at a flow-rate sufficiently high to support such current density, the improvement for effecting the electrodeposition of a lustrous Fe-Zn coating containing 10 to 20% Fe over said line speed range and said current density range, wherein the electrolyte is maintained at a temperature of 130° to 160° F. and consists essentially of 4–10 g/l of $Fe^{2+}$, 50–80 g/l $Zn^{2+}$, 240–300 g/l $Cl^-$, 6–12 g/l $SO_4^{2-}$, 0.5–5 g/l of a chelating agent in an amount sufficient to prevent the formation of ferric ion precipitates, 0.5 to 2 ml/l of an adduct containing one or more polyalkylene glycols having a molecular weight of 600–1050, balance $H_2O$.

6. The method of claim 5, in which the pH of said electrolyte is 2 to 3.5.

7. The method of claim 6, in which said chelating agent is the citrate ion and said polyalkylene glycols are polyethylene glycols.

8. The method of claim 7, in which said polyethylene glycols are employed within the range 0.7 to 1.2 ml/l.

* * * * *